US005400533A

United States Patent [19]

Cruse

[11] Patent Number: 5,400,533

[45] Date of Patent: Mar. 28, 1995

[54] COMBINATION ATTACHMENT AND DECORATIVE FRAME

[76] Inventor: Robert J. Cruse, 11 Nancy Dr., Sayville, N.Y. 11782

[21] Appl. No.: 888,113

[22] Filed: May 26, 1992

Related U.S. Application Data

[63] Continuation-in-part of Ser. No. 691,235, Apr. 25, 1991, abandoned.

[51] Int. Cl.[6] ..... A47G 1/06

[52] U.S. Cl. ..... 40/154; 40/152

[58] Field of Search ..... 40/152, 154, 155, 156, 40/158.1, 159, 159.1, 159.2, 658; 248/467, 473, 488, 205.3

[56] References Cited

U.S. PATENT DOCUMENTS

| | | | |
|---|---|---|---|
| 2,227,541 | 1/1941 | Groff | 248/206.2 |
| 3,098,272 | 7/1963 | Frye | 24/DIG. 11 |
| 3,517,450 | 6/1970 | Greco | 40/638 X |
| 4,301,199 | 11/1981 | Pfanstiehl | 40/158.1 X |
| 4,399,625 | 8/1983 | Langan | 40/155 |
| 4,986,013 | 1/1991 | Pollack | 40/154 X |

*Primary Examiner*—Brian K. Green
*Attorney, Agent, or Firm*—Alfred M. Walker

[57] ABSTRACT

Using an elastomeric material of appropriate rigidity, a decorative frame is formed and attachment to a surface is provided by an integral adhesive strip. The cross section of the framing material reveals a decorative contour and a step which accurately locates the poster or picture to be framed while not bonding it to the frame. Alternatively, a strip of adhesive inside the step can be exposed to bond the art work (or perhaps a transparent over-layer such as glass or acrylic) to the framing members. This latter strip adhesive would facilitate moisture proofing of the art work for application in a humid environment such as a bathroom or pool area.

2 Claims, 3 Drawing Sheets

Fig. 3
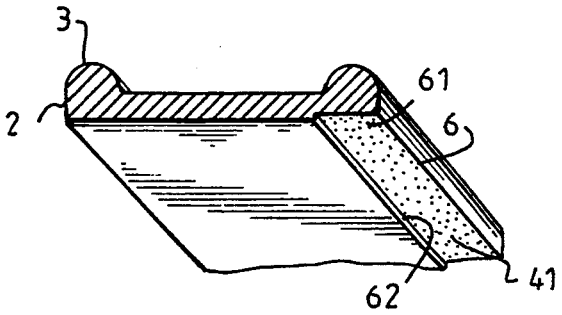
Fig. 4
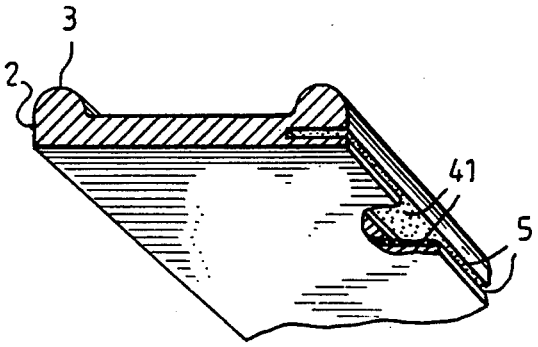
Fig. 5
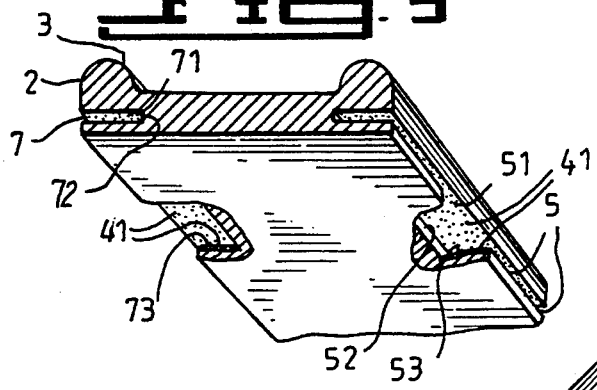
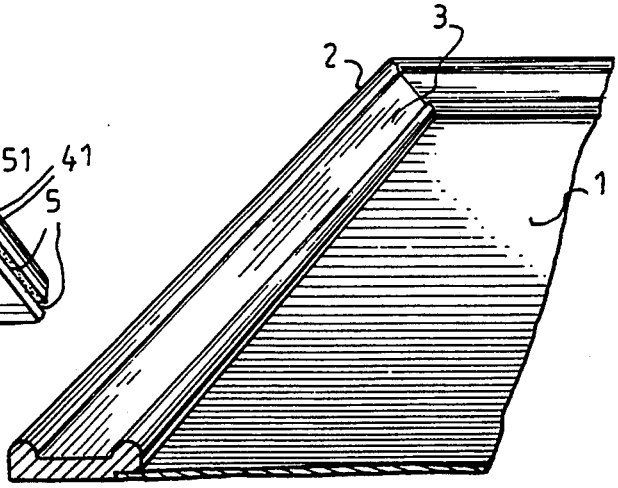
Fig. 6
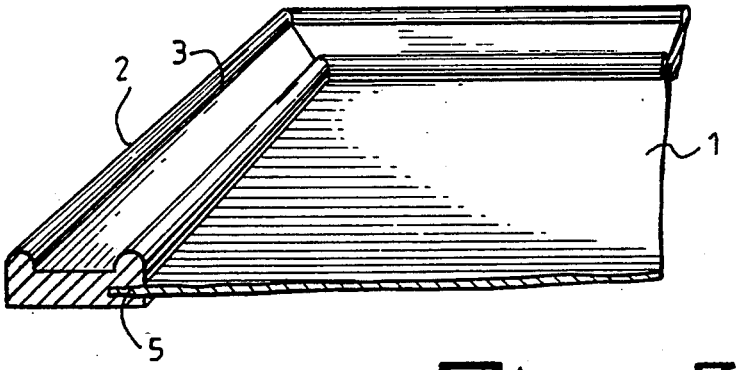
Fig. 7

COMBINATION ATTACHMENT AND DECORATIVE FRAME

This application is a continuation-in-part of application Ser. No. 07/691,235, filed Apr. 25, 1991, now abandoned.

The present invention relates to a three dimensional border tape, to create a picture frame, for flat pictures, such as posters. The border tape is provided with an indented holding marginal incision to accommodate the flat pictures. Thicker items (glued puzzles, etc.) can be displayed with a border tape having wider marginal incisions in accordance with the width of the thick puzzles, etc.

With an elastomeric three dimensional mass material of appropriate rigidity, a decorative frame is formed and an attachment is provided by an integral adhesive strip. The cross section of the framing material reveals an upper three dimensional decorative contour of the material when viewed in profile, and a lower portion with a stepped incision extending within the material which accurately locates the poster or picture to be framed, without permanent bonding. An alternative strip of adhesive on either or both sides of the marginal incision can be provided to attach the poster to the three dimensional border tape. Contoured border tape is merely one of many possible models. Replicated dominoes, playing cards, etc. may also be employed as the surface feature, thus eliminating the need for a "contoured" material when viewed in cross section.

The incision is a slot for receiving one of the edges of the picture. The slot directly contacts and receives the picture, firmly grasping it in a secure manner. The slot has a U-shaped vacuity having a narrow bottom portion and two parallel flat walls, the flat walls having smooth, unbroken surfaces for grasping the picture.

BACKGROUND OF THE INVENTION

Various flat adhesive strips are provided to function as a flat matting frame over flat posters or pictures. These are noted as U.S. Pat. Nos. 4,082,875, 4,229,892, 3,837,987, 3,341,961, 4,110,923, 2,458,349, 4,393,612 and 4,399,625. The latter patent provides for a U shaped shoulder over the edge of a poster. The other patents generally describe flat, adhesive backed matting borders for flat pictures. Three dimensional border tape could also be used in conjunction with a matted picture or poster if the user deemed it necessary.

U.S. Pat. No. 4,399,625 of Langan describes a wide U-shaped channel which does not directly contact and hold a picture, but which further requires a front piece and a backing on both sides of a picture. In addition, while one of the walls of the channel in Langan is smooth, the opposite side is irregular with dove-tailed cut outs to facilitate the fastening of the channel.

U.S. Pat. No. 4,986,013 of Pollack describes a poster having a "T" shaped configuration.

None of the patents provide a decorative, three dimensional border tape which a special incision slot enclosure for receiving and grasping the posters in place in a secure manner in a base portion beneath an upper decorative three dimensional exterior surface of the border tape. These existing framing tapes can be improved.

OBJECTS OF THE INVENTION

Accordingly, it is an object of the invention to provide a decorative three dimensional frame which is an improvement over existing devices.

It is a further object of the invention to provide a decorative three dimensional frame in a continuous roll.

It is a further object of the invention to provide a decorative three dimensional frame which anchors posters or pictures to be framed within the confines of the frame.

It is a further object of the invention to provide a secure fit for pictures or posters within a convenient decorative three dimensional frame.

It is a further object of the invention to provide a 3D framing tape where in one or more posters, pictures or signs, etc. may be placed (inserted) either back to back as in the "storefront window border tape option", or one on top of the other as in the "border tape calendar concept" where in 12 calendar months are placed facing the consumer and as each month passes, the old month is removed and discarded, thus exposing the next month and leaving the rest of the "calendar conglomerate" intact.

It is a further object of the invention to provide the user with a means of do it yourself lamination protection by utilizing the adhesive strip(s) within the marginal incision.

It is a further object of the invention to facilitate framing on surfaces where in the past it was virtually impossible ie. concrete, glass, brick, tile, etc.

It is a further object of the invention to provide the user with virtually unlimited versatility when framing a picture in an irregular configuration.

SUMMARY OF THE INVENTION

With an elastomeric material of appropriate rigidity, a decorative frame is formed to partially cover and frame a flat picture or poster. The cross sectional view cross section of the material reveals a three dimensional contour of the material and an incision within the material to hold the picture or poster in place beneath the surface of the decorative frame. The intended application of the invention is to accurately apply a special three dimensional border tape to frame the paper poster or picture.

The invention also covers a border tape with an angled cross section profile as well as a rectangular version in profile.

The border tape of the present invention is not limited to a "flat-sided" strip. It may also be possible to extend evenly spaced features along the sides of the border tape.

It is an objective of the invention to be able to enclose the paper poster or picture within the frame from a continuous roll of elastomeric framing material.

The step or "incision" in the elastomeric material of the present invention provides a locating function to accurately position the poster or picture within the confines of the frame.

An optional adhesive layer in the step incision area may be included and not used by keeping the adhesive release liner in place. It may be included and used by releasing the liner and removing the liner to expose adhesive for attaching the border tape to a small portion of the picture or poster to be framed.

Elastomeric materials for the decorative three dimensional border tape from a continuous roll may be natural or synthetic rubbers, thermoplastic resins such as the vinyl family, or thermostat materials such as urethanes or silicones. Production materials may include the aforementioned materials. Although it should be understood that the manufacturer is not limited to only these above choices.

Using the elastomeric material of appropriate rigidity, the decorative frame is formed within upper decorative portion and attachment to a surface of a picture is provided by a lower portion having an integral picture holding incision and the adhesive strip. The cross sectional view of the framing material reveals a decorative contour and a step which accurately locates the poster or picture to be framed while not bonding it to the frame. Alternatively, a strip of adhesive inside the step can be exposed to bond the art work (or perhaps a transparent over-layer such as glass or acrylic or thin plastic film) to the framing members. This latter means would facilitate moisture proofing of the art work for application in a humid environment such as a bathroom or pool area.

In order to accurately cut the frame to appropriate sizes, there is included in the design a simple special-purpose miter box usable with an ordinary slicing knife to achieve accurate corner cuts. This could be an injection molded plastic piece or one that is cut from a plastic or aluminum extrusion. The process steps for using such a miter box are as follows:

1. Slip the end of a strip of the decorative border tape of the invention into the miter box (properly aligned for the cut). Looking from above, line up the end of the border tape at the outer edge with the edge of the miter box. Place a small pencil mark at the inner edge of the border tape (edge nearest to poster) where the edge of the miter box crosses.
2. Take strip out of miter box and place next to edge of poster lining up the pencil mark with one end of the poster. Place a second pencil mark on the inner edge of the border tape at the other end of the poster.
3. Use the miter box to cut both ends of the strip at the appropriate angle, by aligning the edge of the miter box with the pencil mark at each end before cutting.

Aside from the basic rectangular or square application facilitated by use of the miter box, the border tape material may be applied over non-classical geometric formations such as a multiplicity of adjacent octagons or irregular wavey configurations. This may be achieved by using a continuous strip conforming to the unique lines of each subject to be framed, ie. a free-form assemblage of photographs.

This procedure will cut a piece whose inner edge is shorter than the poster length by two "offsets". The offsets in the miter box are designed to correspond to the step width ("incision") minus any free space the border tape material user may want to include to minimize wrinkling due to humidity and temperature changes. It is wise to leave a bit of free space to compensate for the hygroscopic nature of paper to grow or shrink by appreciable amounts based on humidity changes. If one "snugs-up" a poster in a frame on a dry day, it will wrinkle badly on a humid day as the paper expands and has nowhere to go. This is why posters are dry mounted to a rigid backing, which is an expensive proposition.

It is useful to keep in mind the size of posters. In most cases a medium sized one is 2 feet by 3 feet, that is having a perimeter of 10 feet. The invention can be produced in pairs of convenient sizes such as 27" (for a 24" edge) or 39" (for a 36" edge) in either trimmed form or untrimmed (appropriate for miter box). Since the elastomeric decorative frame is very soft, it will not take a bad "set" when stored in a roll, however, it will be difficult to tape in place in a very straight line. If it is stiffer, it may take a wavy set on a roll; this can be minimized by using a larger diameter hub on the roll. In irregularly sized posters, custom sizes for the border tape can be employed.

The novel features which are considered characteristic for the invention are set forth in the appended claims. The invention itself, however, both as to its construction and its method of operation,together with additional objects and advantages thereof,will best be understood from the following description of specific embodiments when read in connection with the accompanying drawings.

BRIEF DESCRIPTION OF THE DRAWINGS

FIG. 3 is a close up sectional front view of the device as shown in FIG. 1.

FIG. 4 is an alternate view of the device.

FIG. 5 is an alternate view of the device.

FIG. 6 is a perspective view of the device as shown in FIG. 1.

FIG. 7 is a close-up perspective view in partial section of the device as shown in FIG. 4.

DESCRIPTION OF THE PREFERRED EMBODIMENT

Figure 1:
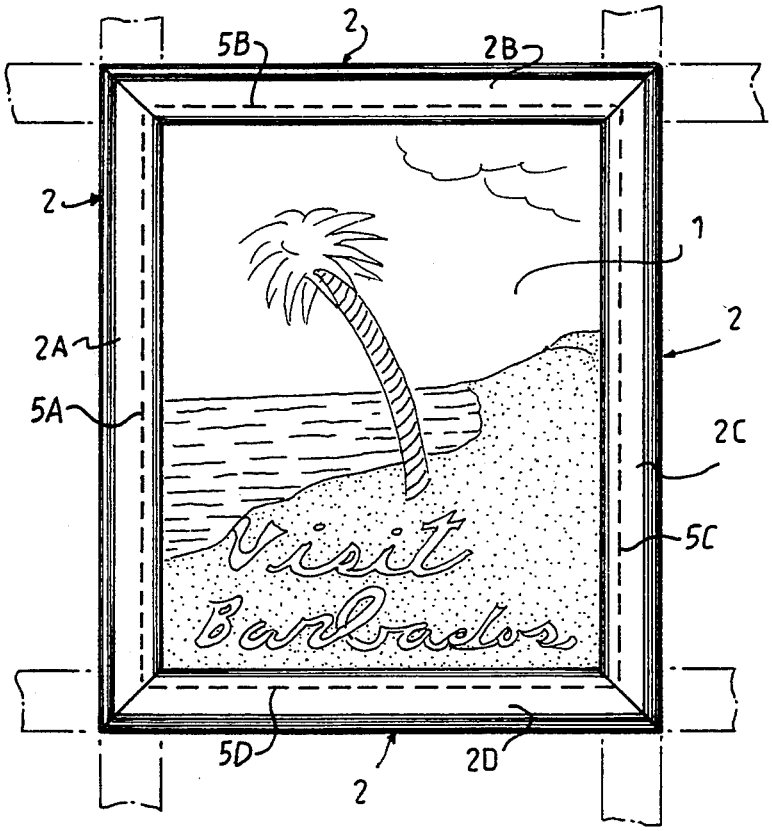
FIG. 1 is a top view of the device as applied to a flat paper.

An elastomeric decorative three dimensional border tape frame in accordance with the invention is applied over a flat poster or picture 1, which frame is identified as a whole with reference numeral 2.

As shown in FIG. 1, the three dimensional frame 2 is placed over flat poster or picture 1 in separate strips 2A, 2B, 2C and 2D.

The strips 2 are overladen with an upper three dimensional design configuration 3 and underladen with a lower flat surface 4 for placing the strips 2 against a wall.

In the preferred embodiment as shown in FIGS. 1, 2, 4, and 7, the frame strip 2 has a partial incision 5 extending from the inner surface 31 of decorative top portion 3 with respect to the inside of frame 2

The incision 5 includes a slot for receiving one of the edges of the picture. The slot directly contacts, receives and firmly grasps picture 1 in a secure manner. The slot has a U-shaped vacuity having two parallel flat walls 51 and 53 and a narrow base wall 52, the flat walls 51,52 and 53 having smooth, unbroken surfaces for grasping the picture 1.

The incision 5 extends partially outward from the inner surface 31 of decorative top portion 3 towards, but not as far as, outer surface 32 of decorative top portion 3 of strip 2. The flat poster or picture 1 is placed snugly up against rear surface 52 between top holding surface 51 and bottom holding surface 53 of incision portion 5 of frame strip 2. As shown in FIGS. 4,5 and 7, incision 5 extends deeper along top surface 51 and bottom surface 53 than it is wide along rear base portion 52. An optional adhesive surface 41 with a peel away cover (not shown) is provided within incision 5 against top holding surface 51. If desired, the peel away cover (not shown) can be removed to expose adhesive surface 41 for adhering top holding surface 51 against flat poster or picture 1, which poster or picture 1 is snugly held within incision 5 of frame strip 2.

The corresponding frame strips 2A, 2B, 2C and 2D each have corresponding incisions 5A, 5B, 5C and 5D for the four sides of the decorative frame provided by the four frame strips 2A, 2B, 2C and 2D.

As shown in FIGS. 3 and 6, there is depicted an alternate cantilevered incision 6 which has rear surface 62 and top holding surface 61, against which is placed poster or picture 1. However, in this version, because of the lack of a bottom holding surface corresponding to bottom holding surface 53 in the preferred embodiment, adhesive tape (not shown) must be employed to hold the poster or picture 1 within the confines of decorative border frame 2. In the preferred embodiment as described before, the poster or picture 1 can fit snugly within incision 5 with or without an adhesive surface 41, depending upon the tightness of the fit of the poster or picture 1 within frame 2.

Figure 2:
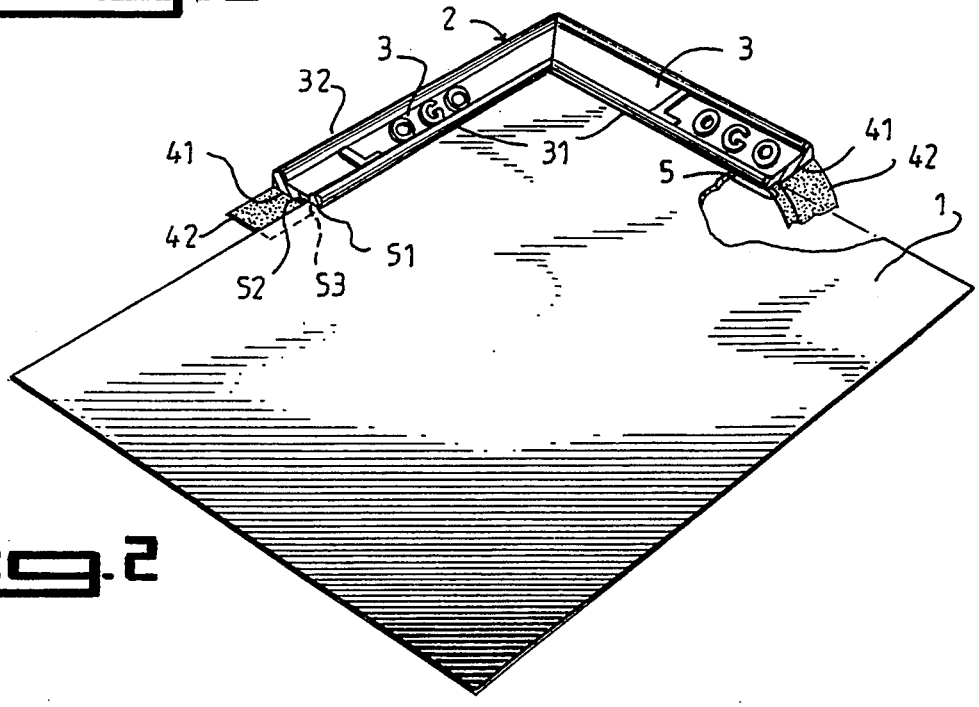
FIG. 2 is a perspective view in partial section of a portion of the device.
Figure 8:
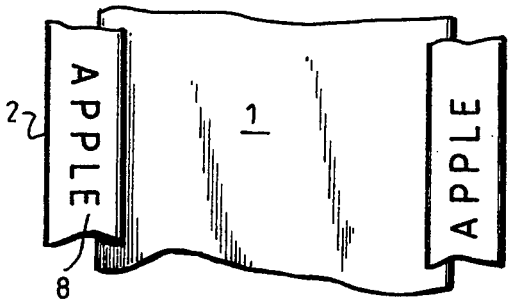
FIG. 8 is a close up top view of the device with decorative lettering.
Figure 8A:
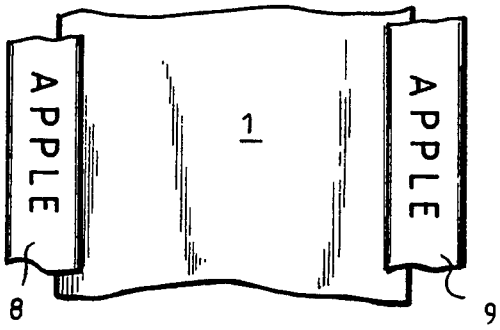
FIG. 8A is a close-up top view of the device as shown in FIG. 5.

When the decorative three dimensional configuration 3 contains lettering as shown in FIGS. 5, 8 and 8A, it is necessary to provide an opposite incision 7 having rear surface 72, top holding surface 71 and bottom holding surface 73 in which to insert poster or picture 1. When lettering with opposite alignment as shown in FIG. 8 is desired, the preferred embodiment as shown in FIGS. 2, 4 and 7 may be employed. However, when it is desired to have the lettering with the tops aligned parallel as shown in FIG. 8A, then the embodiment in FIG. 5 with opposite incisions 5 and 7 must be employed.

Figure 9:
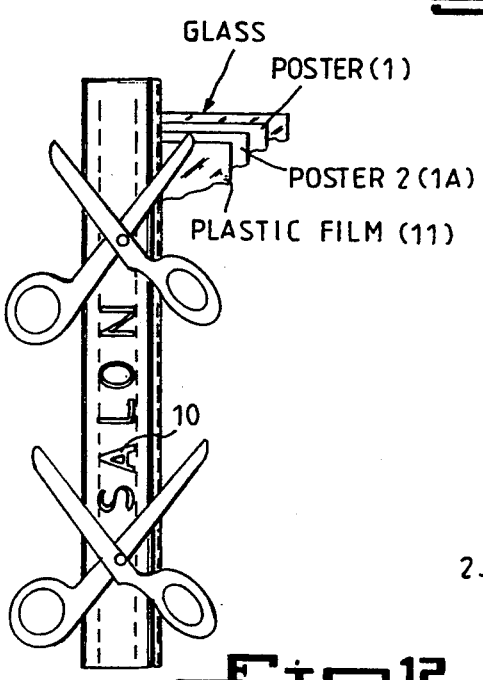
FIG. 9 is a top view of an alternate embodiment of the device.
Figure 10:
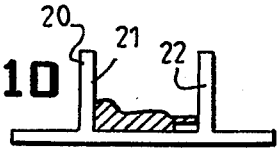
FIG. 10 is a front view in partial section of the frame holding cutter portion of the device.
Figure 11:
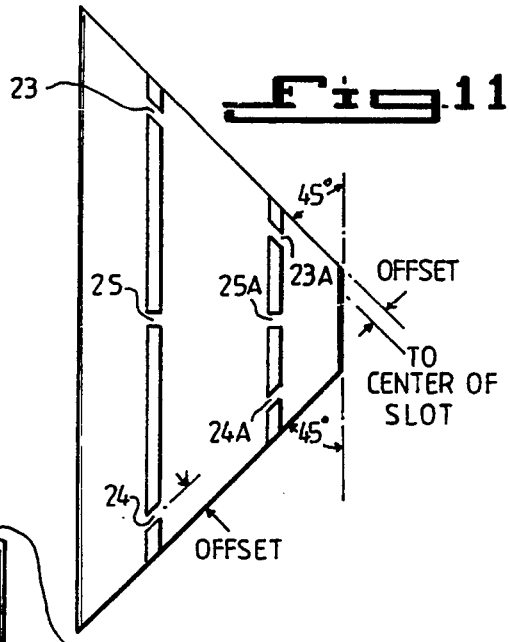
FIG. 11 is a top view of the frame holding cutter portion of the device.
Figure 12:
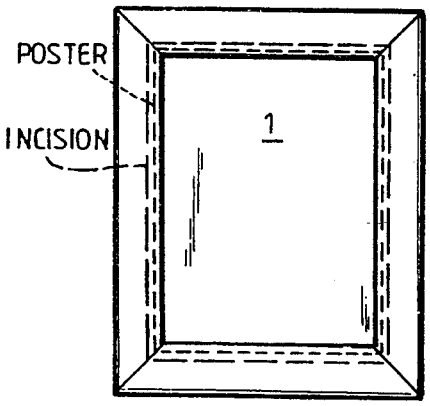
FIG. 12 is a top view of the device with dotted lines to indicate the positions of the poster within the incisions.
Figure 12A:
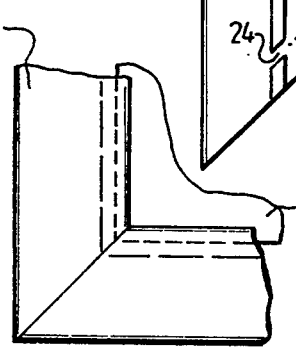
FIG. 12A is a close-up view of the device as shown in FIG. 12.

As shown in FIG. 9 a double sided tape may be used for displaying posters on the outside and inside of storefront windows.

FIGS. 10, 11, 12 and 12A show the method of cutting the individual strips 2A, 2B, 2C and 2D from continuous strip 2.

Included in the design is a simple special purpose mitre box 20 having upward extending holding members 21 and 22 for holding frame strip 2 within mitre box 20.Pairs of slots 23, 23A and 24, 24A are provided at 45 degree angles for cutting frame strips 2A, 2B, 2C and 2D appropriately at the corners where the respective strips meet.

Figure 13:
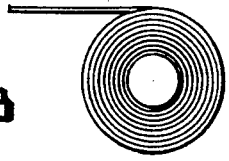
FIG. 13 is a side view of the frame tape material in a continuous roll.

As can be seen in FIG. 13, decorative three dimensional frame strip 2 is provided in a continuous roll.

Because of the thick nature of the three dimensional decorative portion above the linear support strip, it is necessary to calculate the linear length of the continuous strip of frame tape, so that the diameter of the roll can be ascertained. The procedure for estimating the size of the roll of tape is as follows:

Procedure for estimating the size of a roll-of tape:

$$L = \frac{\pi r_m}{t} \tag{1}$$

Calculate $L_e$:

$$L_e = \frac{\pi (d)^2}{t} \text{ rolls of tape:} \quad d \quad d_m = 2d_m \tag{2}$$

Then set L in equation (1) equal to the desired length of tape plus L $$L \text{ total} = L \text{ desired} + Le \tag{3}$$

Solve for the radius of the roll as follows:

$$r_m = \sqrt{\frac{t\,(L \text{ total})}{\pi}} \tag{4}$$

The outer diameter is twice this:

$$d_m = 2\, r_m \tag{5}$$

An example—Assume
L desired = 15 feet
$t = \frac{1}{4}''$
$d = 4''$ (hub diameter)

$$Le = \frac{\pi \frac{(d)^2}{2}}{\pi} = \frac{\pi \frac{(4)^2}{2}}{1/4} = 50.2''$$

$$L \text{ desired} = 15 \text{ feet} = 180''$$

$$r_m = \sqrt{1/4 \frac{(180 + 50.2)}{\pi}} = 4.3''$$

$$d_m = 2(4.3) = 8.6''$$

The invention is not limited to the details shown, since various modifications may be made without departing from the spirit of the present invention.

What is desired to be protected by Letters Patent is set forth in the appended claims.

I claim:

1. A decorative, three dimensional picture frame comprising:

a plurality of linear frame support strips cut from a continuous strip of elastomeric mass material having a three dimensional configuration in contour when each of said linear frame support strips is viewed in profile;

each of said linear frame support strips for extending continuously along and supporting an edge of the picture;

each of said linear support strips having a lower continuous support portion integral with an upper decorative portion, said lower continuous support portion being located under said upper decorative portion of each of said linear frame support strips;

a partial first incision within each of said lower continuous support portions of each of said linear frame support strips for housing the picture within each of said incisions of each of said linear frame support strips;

said partial first incision comprising a slot for receiving one of the edges of the picture;

said slot being for contacting, receiving and firmly grasping the picture in a secure manner;

said partial first incision comprising a U-shaped vacuity having a narrow base portion and two parallel top and bottom continuous straight flat walls which extend from said narrow base portion, said top and bottom flat walls further comprising smooth, unbroken surfaces for grasping said picture, said flat walls extending longitudinally lengthwise at a distance greater than the distance between said top and bottom flat walls along a height of said base portion, said partial first incision extending partially through each of said continuous support portions under each said upper decorative portions of each of said linear frame support strips, each said incision extending towards, but not as far as, an outer surface of each said lower continuous support portions extending within each of said linear frame support strips;

each of said linear frame support strips further including an opposing second incision being located opposite said partial first incision.

2. The frame as in claim 1, further comprising an adhesive strip, said adhesive strip having an adhesive coating disposable against a portion of said picture; said adhesive strip being positioned within each of said first and second incisions each for bonding said picture within each of said first and second incisions of said linear support strips.

* * * * *